United States Patent [19]

Santorineos

[11] Patent Number: 4,721,545

[45] Date of Patent: Jan. 26, 1988

[54] BALLOON SEALER

[76] Inventor: Christos Santorineos, 5643 Woodbury Ave., Montreal, Quebec, Canada, H3T 1S6

[21] Appl. No.: 902,618

[22] Filed: Sep. 2, 1986

[51] Int. Cl.[4] ..... B65B 51/08

[52] U.S. Cl. ..... 156/468; 53/583

[58] Field of Search ..... 53/583, 399; 156/468, 156/475, 486

[56] References Cited

U.S. PATENT DOCUMENTS

| | | | |
|---|---|---|---|
| Re. 28,170 | 9/1974 | Lehmann | 53/583 X |
| 2,841,935 | 7/1958 | Krueger | 53/583 X |
| 2,909,019 | 10/1959 | MacBride . | |
| 2,916,863 | 12/1959 | Leighton et al. | 53/583 X |
| 3,729,896 | 5/1973 | Lehmann | 53/583 X |

FOREIGN PATENT DOCUMENTS

| | | |
|---|---|---|
| 597557 | 5/1960 | Canada . |
| 597784 | 5/1960 | Canada . |

*Primary Examiner*—David Simmons

[57] ABSTRACT

A sealer for inflated balloons, consisting of a casing having a vertical transverse channel open at its upper end. A toothed wheel is mounted on one side of the channel and a resilient strip on the other side. The strip has an operative portion extending in the channel in curved abutting relation to the wheel. The latter and the strip cooperatively define a V-shape notch. Pressure adhesive tape extends from a spool around the toothed wheel. A cutting member is pivoted below the wheel and the strip. Pressing a balloon neck downwardly actuates the wheel and causes the leading portion of the tape to be peeled back from the strip and adhere to the incoming portion of the tape, thus surrounding the neck of the balloon.

11 Claims, 6 Drawing Figures

BALLOON SEALER

FIELD OF THE INVENTION

The present invention relates to sealing and tieing devices for bags and other amorphous containers, more specifically to a device for sealing inflated balloons.

BACKGROUND OF THE INVENTION

The prior art has provided various devices for sealing different kinds of bags with pressure adhesive tapes or rubber bands. However, and till now, no satisfactory machine or device has been developed to seal ordinary rubber or plastic inflatable balloons. To maintain a balloon in inflated condition the neck must therefore be tied into a knot or tied with string, tape or the like. None of these methods seal air-tightly and must, moreover, be done manually.

OBJECTS OF THE INVENTION

In view of the above it is a prime object of the present invention to provide a balloon sealer which effectively, instantly seals an inflated rubber or plastic balloon with pressure adhesive tape at the neck.

It is another object of the invention to provide a balloon sealer of the character described which is simple in design and which is feasible for the market-place.

SUMMARY OF THE INVENTION

The above and other objects and advantages of the present invention are realized by a preferred embodiment comprising a casing having a support means to support the sealer on a preferably horizontal surface.

The casing is preferably rectilinear, defining an interior space or minimal width and narrower than the length of a balloon neck.

The casing is provided with a transverse vertical channel open at its uppe end and having a wider lowermost portion.

Rotatably mounted in the interior space of th casing is a toothed wheel which projects partially into the upper portion of the channel. A cutting member is also pivotally mounted in the interior space. The cutting member is integrally formed with a balloon neck-contacting surface extending across the transverse channel and constituting an actuation means for the cutting member. A sealed balloon neck pushed against this surface will force the cutting element to pivot into the channel below the wheel. Biasing means are prvided to bias the cutting element in retracted position out of the channel.

On the opposite side of the channel is secured a semi-resilient guide strip having a curved end portion in abutting relationship with the toothed wheel, defining a V-shaped notch between itself and the latter.

The opposite end portion of the casing has rotatably mounted therein a spool carrying pressure adhesive tape such as the kind known under the trademark name "Scotch Tape". The free end portion of the tape extends around the toothed wheel with the adhesive side of the tape facing outwardly so that it adheres to the operative portion of the guide strip. Ideally the casing will be only slightly wider than the width of the tape selected.

An inflated balloon is sealed as follows: the neck is pinched by the fingers of the two hands adjacent the inflated portion and adjacent the neck opening. The balloon neck is then pressed downwardly into the V-shape notch. Such action causes the adhesive tape to adhere to the neck and the latter is pressed between two teeth of the wheel. As the latter turns the leading portion of the tape is peeled away from the guide strip and made to adhere to the incoming tape thereby effectively sealing the neck all around its circumference. Further pressing downwardly actuates the cutting element to cut the tape, preferably not too far from the sealed neck. The seal thus obtained is consistently airtight.

There is accordingly disclosed a balloon sealer comprising: a casing defining a width narrower than the length of a balloon neck; said casing being provided with a transverse vertical channel opened at its upper end; a toothed wheel rotatably mounted in the interior space of said casing and arranged to partially project into said channel; a resilient guide strip anchored at one end to said frame and freely extending at its other end portion transversely of said channel; said guide strip other end portion defining a curved end flange, bent back toward said channel and extending partly therethrough, and a main portion biased against said toothed wheel and cooperatively defining with said wheel a V-shape notch in said channel; a spool carrying pressure-adhesive tape further mounted in said interior space; said spool dispensing said tape with the adhesive side of the tape facing outwardly; said tape extending around said wheel and adhering to said operative portion of said strip; further comprising a cutting member having a main body, a pivot axle pivotally connecting said main body transversely to said casing, said pivot axle parallel to the rotational axis of both said toothed wheel and said spool, said main body coplanar to said toothed wheel, a cutting blade fixedly mounted to an outer end of said main body, said cutting blade lying in a plane substantially parallel to said pivot axle, said main body further defining an elongated edge bounded at one end by said cutting blade and having an opposite free end; the distance between the leading edge of said cutting blade and said main body pivot axle being substantially longer than the distance between said pivot axle and the section of said main body elongated edge closest to said pivot axle; biasing means to bias said main body to a first limit retracted position, in which said elongated edge thereof projects transversely of said casing vertical channel; said main body pivotable against the bias of said biasing means to an intermediate position, in which the leading edge of said cutting blade shears against the exterior face of said guide strip curved end flange to cut a section of said adhesive tape thereagainst, and to a second limit position wherein said elongated edge clears said channel; wherein said balloon neck of an inflated balloon is adapted to engage said casing vertical channel upper end and, successively, to be manually forcibly lowered through same channel, to be surroundingly adhered by a portion of said adhesive tape, to engage said section of the main body elongated edge transversely registering with said pivot axle, to thereafter pivot said cutting member to cut said tape against said guide strip end flange by sliding along said main body elongated edge away from said cutting blade so as to clear said elongated edge free end at said second limit position.

Advantageously, said casing transverse channel opened end defines two opposite rounded edges. Said cutting member main body may includes a through-bore, said through-bore along a virtual axis passing through said pivot axle and said cutting blade leading edge on a side opposite said cutting blade relative to said pivot axle; said biasing means consisting of a tension spring engaged at one end into said main body through-bore and at the other end to an anchor member fixedly secured to said casing well below said main body pivot axle.

Preferably, said main body elongated edge defines a concave shape, wherein the concavity of said elongated edge may form a circle of arc defining a radius of a virtual circle much longer than that of the virtual circular section swept by said cutting blade leading edge during pivotal of said cutting member main body between the two limit positions thereof.

The distance between the leading edge of said cutting blade and said main body pivot axle is profitably about twice as long as the distance between said pivot axle and the section of said main body elongated edge closest to said pivot axle.

Said cutting member pivot axle and the toothed wheel rotational axis may define an axis parallel to said casing vertical channel.

More broadly stated, the invention can be said to consist of a rigid frame, an elongated vertical channel in said frame defining a top mouth, a sprocket, a first pivot axle to pivot said sprocket to said frame for rotation about a plane parallel to the plane defined by said channel, an arcuate section of said sprocket projecting in register with a fraction of the width of said channel proximate said mouth; feed means to feed a band of adhesive tape to said sprocket; a resilient guide strip, anchored at one end to said frame and freely extending at its other end portion transversely of said channel; said guide strip other end portion defining a curved end flange, bent back toward said channel and extending partly therethrough, and a main section, in register with and biased against said sprocket; a block member, a second pivot axle to pivot said block member to said frame proximate to an intermediate section of said channel for rotation about the same plane as said sprocket, said block member including an elongated side edge provided with a cutting blade at one end, said block member further including a projection transversely opposite said cutting blade relative to said second pivot axle; a tension spring, connected at one end to said projection and anchored by another member at the other end to a point of said frame well below said block member, said tension spring pivotally biasing said block member to a first resting position in which said block member elongated edge extends transversely of said channel with said cutting blade in substantial register with said sprocket; whereby an inflated balloon neck passed through said mouth and forcibly lowered into said channel will be surroundingly connected by said adhesive tape and will strike said block member elongated edge whereby said block member will pivot against the bias of said tension spring and said cutting blade will shear against the exterior face of said guide strip curved end flange to concurrently cut a downstream section of said adhesive tape band against said curved end flange proximate said balloon neck. The taped balloon neck is then further lowered downwardly through said channel beyond said block member.

In such balloon sealer, said pivot axles may define an axis parallel to said channel; wherein said anchor member could be located outwardly of the axis passing through said pivot axles, relative to said channel.

BRIEF DESCRIPTION OF THE DRAWINGS

The above will be more clearly understood by having referral to the preferred embodiment of the invention, illustrated by way of the accompanying drawings, in which.

Like reference characters indicate like elements throughout the drawings.

DETAILED DESCRIPTION OF THE PREFERRED EMBODIMENTS

Figure 1:
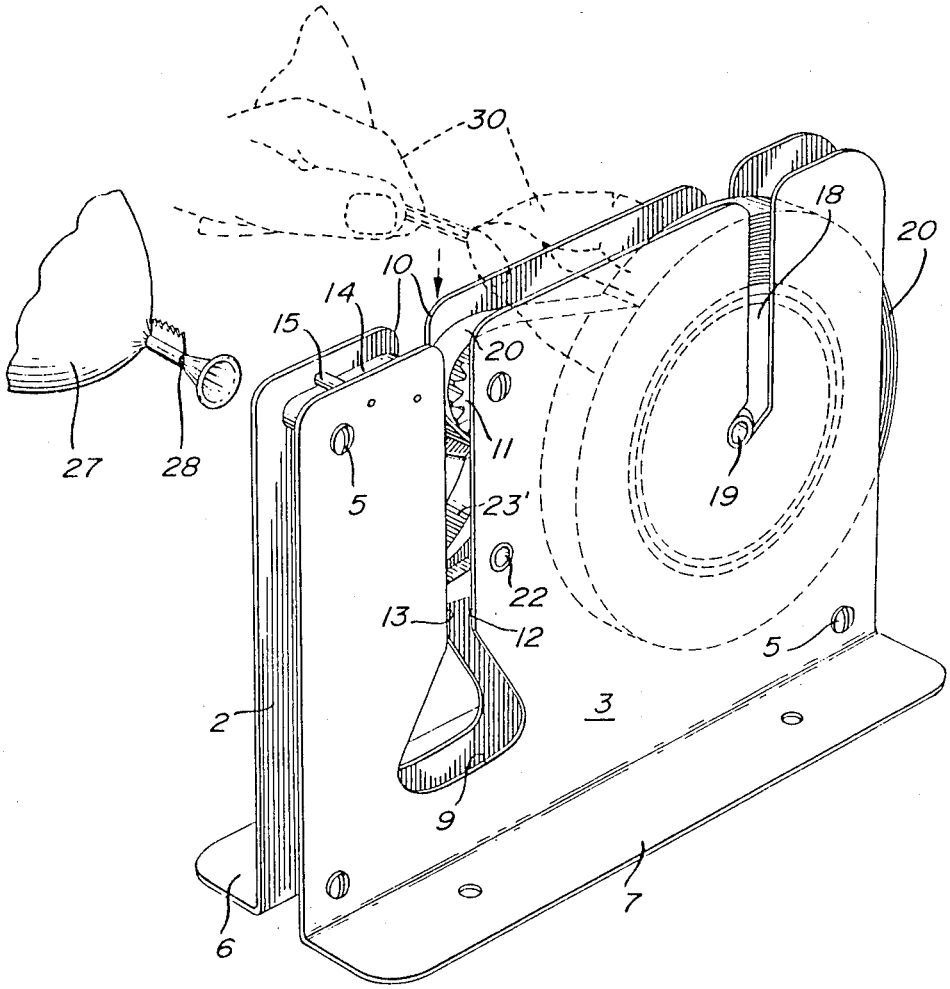
FIG. 1 is a perspective view of the sealer according to the invention, also showing a portion of a sealed balloon and a pair of hands grasping the neck in dashed outline.
Figure 2:
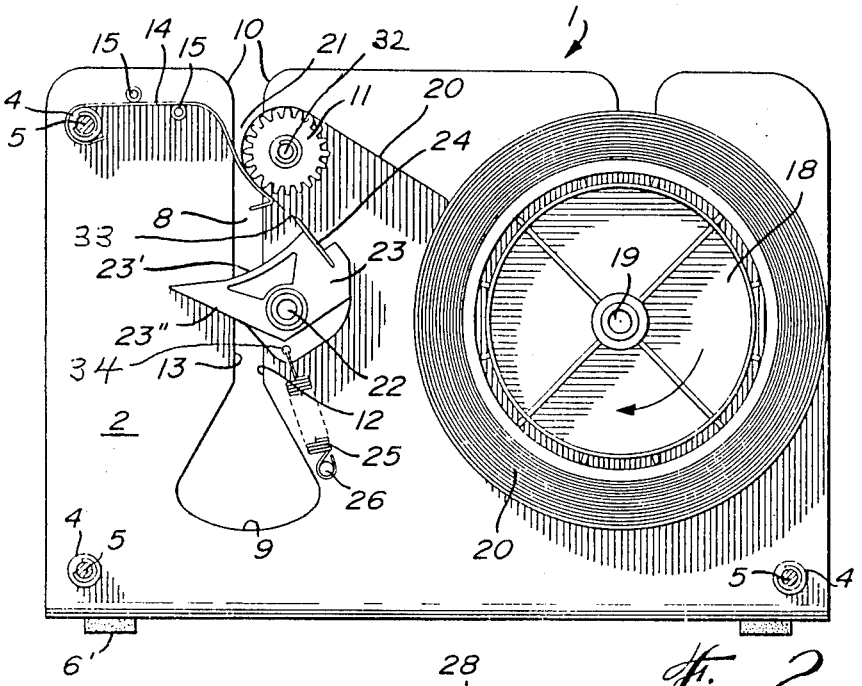
FIG. 2 is a side elevation of the sealer without one plate of the casing, showing various elements in rest position.

Referring to FIGS. 1 and 2, there is shown a balloon sealer 1, according to the invention. Sealer 1 is comprises of a casing made of two parallel plates 2, 3 secured together by appropriate spacers 4 and screws 5. Plates 2, 3 each have lower supporting flanges 6, 7 to support the casing on a flat level surface. Flanges 6, 7 are provided with pads 6'.

Plates 2, 3 are both provided with vertically extending slots opening at the top edges of the plates. The slots are in register with each other, and together with the interior space of the casing define a transverse vertical channel 8. The lower portion 9 of channel 8 is enlarged relative to the width of the slots. Preferably the upper edges of channel 8 are rounded, as at 10. Channel 8 defines first and second edges 12 and 13 respectively, of which only one of each is shown.

A small wheel 11 having teeth 11' is rotatably mounted to a pivot axle 32 journalled between plates 2 and 3 adjacent the top edges of the latter and on the same side of channel 8 as first edge 12. Wheel 11 is arranged to partially project into approximately one-half the width of channel 8.

On the second or opposite side of channel 8 a rigid semi-resilient strip 14 is attached to one of the upper spacers 4. A pair of longitudinally staggered pins 15 keep the inoperative portion of strip 14 in a straight condition. Strip 14 is bent downwardly at 16 and has an operative portion which extends into channel 8 at a predetermined angle and with a slight curve corresponding to the curvature of wheel 11 so that the operative portion 14' (FIGS. 4–5) lightly abuts against wheel 11. The free end 17 of strip 14 is back bent towards the second edge 13 of channel 8.

On the same side of channel 8 as wheel 11 is a spool 18 rotatably mounted on a transverse short axle 19. Spool 18 has wound thereon pressure adhesive tape 20 of the kind suggested above.

As clearly shown in FIG. 2 tape 20 is unwound from the spool with its adhesive side facing outwardly and is thus made to adhere to the operative portion 14' of strip 14.

Strip 14 and wheel 11 define between them a generally V-shape notch 21 in channel 8.

Spaced below wheel 11 and mounted on a pivot stub 22 in a vertical alignment with the axis of wheel 11 is a cutting member 23. The latter includes a cutting blade 24, preferably having a serrated projecting cutting edge 33 and an elongated slightly concavely curved surface 23'. The latter extends from a point adjacent the edge of blade 24 to the apex of a triangular portion 23".

Figure 3:
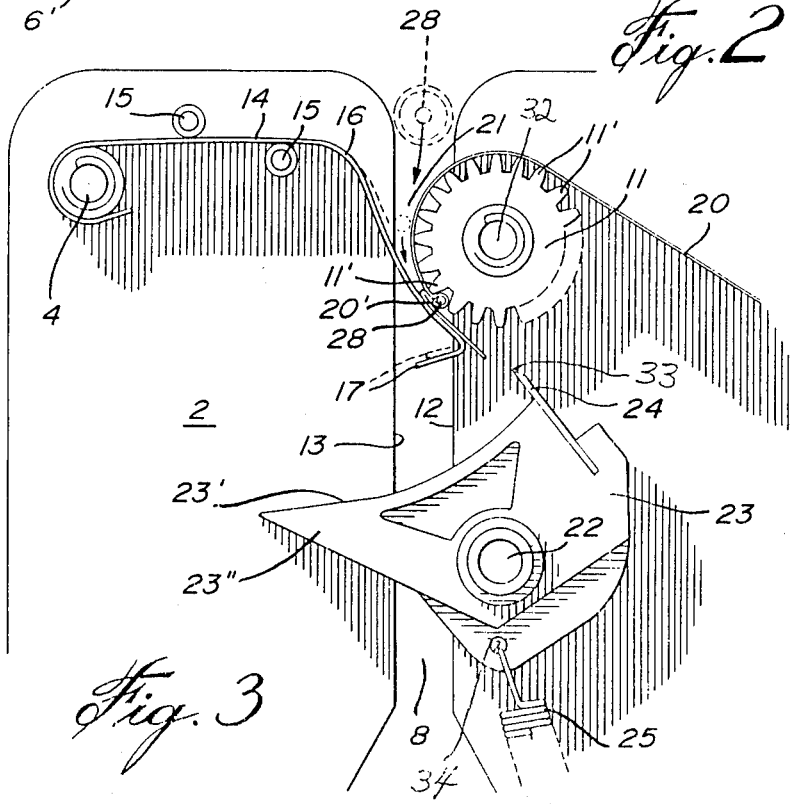
FIGS. 3, 4, and 5 are enlarged side elevations of the working elements of the sealer showing sequentially how a balloon neck is sealed according to the invention, FIG. 3 being at a larger scale than FIGS. 4 and 5.

FIGS. 2 or 3 show the rest position of member 23 wherein surface 23' crosses channel 8 with a downward slope towards edge 13.

A biasing means is provided to yieldingly maintain member 23 in the above position, consisting of a tension spring 25 secured at one end to a through-bore 34 in the lower part of a member 23 and to a peg 26 at its opposite end. Peg 26 is attached to plates 2, 3 well below pivot 22. Bore 34 is coaxial with pivot 22 and cutting edge 33.

FIG. 2 illustrates sealer 1 in rest position.

FIGS. 1, 3, 4, 5 depict how a balloon 27 having a neck 28 is sealed.

Figure 6:
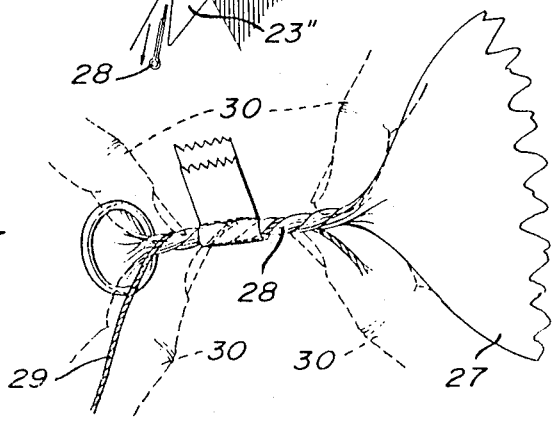
FIG. 6 is a perspective view of a sealed balloon neck and string, showing fingers in dashed outline.

Firstly, the balloon 27 is grasped as described and the neck is twisted as in FIG. 6. Then the neck 28 is pressed by fingers 30 into the V-shape notch 21 so that it adheres to the tape 20 at the bottom of notch 21.

Further downward pressure on neck 28 causes wheel 11 to begin to turn and at the same time forces neck 28 between two teeth 11' of wheel 11. Preferably, the inner width of each "valley" between pairs of teeth 11' is slightly less than the diameter of a twisted neck 28. As wheel 11 turns the rear tooth 11' thereat forces the neck 28 to move along therewith. While this occurs the upward force exerted by strip 14 on neck 28 keeps the latter firmly between said pair of teeth 11; 11' as wheel 11 continues to turn, and as downward pressure is further exerted on neck 28, strip 14 begins to deflect into channel 8. When this occurs, the portion 20' of tape 20 located at the bottom of the V-shape notch 21 is pulled free of strip 14 and is adhered to that portion of the tape adjacent rear tooth 11", thereby closely air-tightly sealing the balloon neck 28, as clearly seen in FIG. 3 (tape 20 is shown as being much thicker that it actually is for purposes of description). The rest of the leading part of tape is progressively peeled back and adhered to the incoming tape.

Figure 4:
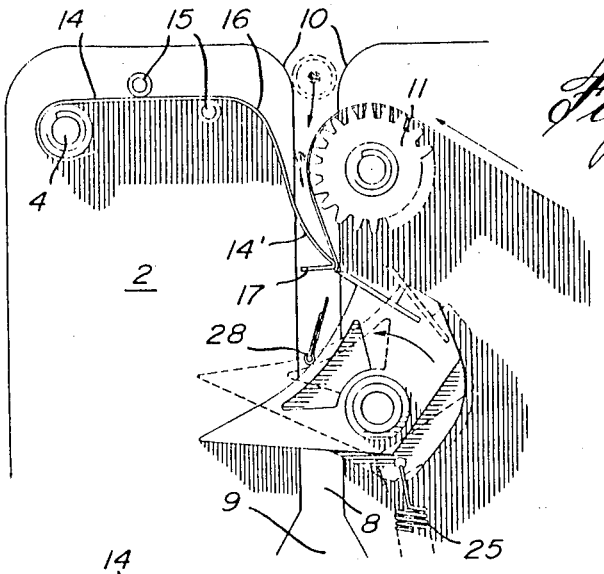
Figure 5:
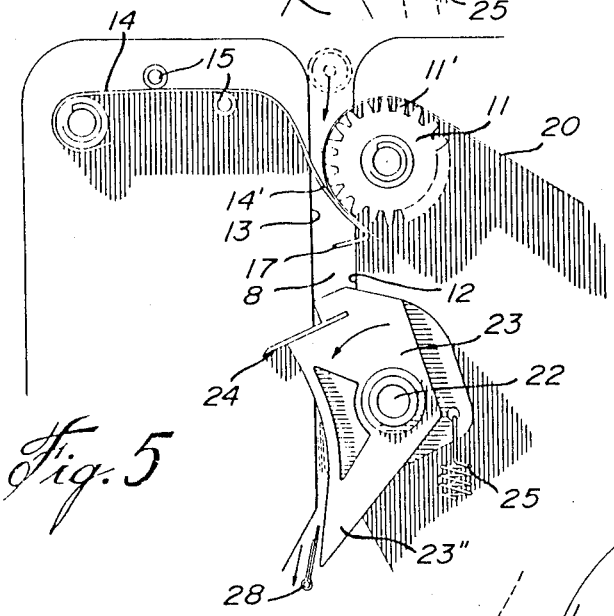

Further downward pressure deflects strip 14 to a lowermost position in channel 8, as in FIG. 4, and neck 28 will slide along channel edge 12 until it contacts surface 23'. Sliding along the latter the neck 28 will pivot cutting member 23 until cutting blade 24 cuts a section of the tape downstream from and proximate to the neck 28; as shown in FIG. 4, and until the sealed neck 28 clears said apex of the cutting member triangular portion 23", as shown in FIG. 5. It is then a simple matter to withdraw the sealed balloon neck from enlarged channel portion 9 in the casing.

FIG. 6 shows how a string 29 may be wrapped around neck 28 in spiral fashion prior to inserting the neck into the sealer of the invention.

What I claim is:

1. A balloon sealer comprising: a casing defining a width narrower than the length of a balloon neck; said casing provided with a transverse vertical channel open at its upper end; a toothed wheel rotatably mounted in the interior space of said casing and arranged to partially project into said channel; a resilient guide strip anchored at one end to said frame, having its main portion biased against the teeth of said wheel and freely extending transversely of said channel; said guide strip having a free end portion defining a curved end flange, bent back toward said channel and extending partly therthrough, said main portion, cooperatively defining with said wheel a V-shape notch in said channel; a spool carrying pressure-adhesive tape further mounted in said interior space; said spool dispensing said tape with the adhesive side of the tape facing outwardly; said tape extending around said wheel and adhering to said main portion of said strip; further comprising a cutting member having a main body, a pivot axle pivotally connecting said main body transversely to said casing, said pivot axle parallel to the rotating axis of both said toothed wheel and said spool, said main body coplanar with said toothed wheel, a cutting blade fixedly mounted to an outer end of said main body, said cutting blade lying in a plane substantially parallel to said pivot axle and having a leading cutting edge movable through an arc of a circle intersecting said free end portion of said guide strip, said main body further defining an elongated edge bounded at one end by said cutting blade and having an opposite free end; the distance between the leading edge of said cutting blade and said main body pivot axle being substantially longer than the distance between said pivot axle and the section of said main body elongated edge closest to said pivot axle; biasing means to bias said main body to a first limit retracted position, in which said elongated edge thereof projects transversely of said casing vertical channel; said main body pivotable against the bias of said biasing means to an intermediate position, in which the leading edge of said cutting blade shears against the exterior face of said guide strip curved end flange to cut a section of said adhesive tape thereagainst, and to a second limit position; wherein the free end of said elongated edge clears said vertical channel; wherein said balloon neck of an inflated balloon is adapted to engage said casing vertical channel upper end and, successively, to be manually forcibly lowered through same channel to engage between two teeth and rotate said wheel, to be surroundingly adhered by a portion of said adhesive tape, to engage said main body elongated edge, to thereafter pivot said cutting member between said two limit positions thereof by sliding along said main body elongated edge away from said cutting blade and thus cause said leading edge tu cut said tape against said guide strip free end portion, said ballon neck finally clearing said elongated edge free end at said second limit position.

2. A balloon sealer as defined in claim 1, wherein said channel widens at its lower end portion.

3. A balloon sealer as defined in claim 1, wherein said casing transverse channel opened end defines two opposite rounded edges.

4. A balloon sealer as defined in claim 1, wherein said cutting member main body includes a through-bore, said through-bore along a virtual axis passing through said pivot axle and said cutting blade leading edge on a side opposite said cutting blade relative to said pivot axle; said biasing means consisting of a tension spring engaged at one end into said main body through-bore and at the other end to an anchor member fixedly secured to said casing, well below said main body pivot axle.

5. A balloon sealer as defined in claim 1, wherein said main body elongated edge defines a concave shape.

6. A balloon sealer as defined in claim 5, wherein the concavity of said elongated edge forms a circle of arc defining a radius of a virtual circle much longer than that of the virtual circular section swept by said cutting blade leading edge during pivotal of said cutting member main body between the two limit positions thereof.

7. A balloon sealer as in claim 1, wherein the distance between the leading edge of said cutting blade and said main body pivot axle is about twice as long as the distance between said pivot axle and the section of said main body elongated edge closest to said pivot axle.

8. A balloon sealer as defined in claim 1, wherein said cutting member pivot axle and the toothed wheel rotational axis define an axis parallel to said casing vertical channel.

9. A balloon sealer comprising:

a rigid frame, an elongated vertical channel in said frame defining a top mouth, a sprocket, a first pivot axle to pivot said sprocket to said frame for rotation about a plane parallel to the plane defined by said channel, an arcuate section of said sprocket projecting in register with a fraction of the width of said channel proximate said mouth; feed means to feed a band of adhesive tape to said sprocket; a resilient guide strip, anchored at one end to said frame and freely extending at its other end portion transversely of said channel; said guide strip other end portion defining a curved end flange, bent back toward said channel and extending partly therthrough, and a main guide strip portion biased against said sprocket; a block member, a second pivot axle to pivot said block member to said frame proximate to an intermediate section of said channel for rotation about the same plane as said sprocket, said block member including an elongated side edge provided with a cutting blade at one end, said block member further including a projection transversely opposite said cutting blade relative to said second pivot axle; a tension spring, connected at one end to said projection and anchored by an anchor member at the other end to a point of said frame well below said block member, said tension spring pivotally biasing said block member to a first resting position in which said block member elongated edge extends transversely of said channel with said cutting blade in substantial register with said sprocket; said blade having a leading cutting edge movable in a circular path coming in sliding contact with said end flange; whereby an inflated balloon neck can be passed through said mouth to be forcibly lowered into said channel to be surroundingly connected by said adhesive tape and to strike said block member elongated edge whereby said block member is pivoted against the bias of said tension spring so that said cutting blade shear against the exterior face of said guide strip curved end flange to concurrently cut a downstream section of said adhesive tape band against said curved end flange proximate said balloon neck.

10. A balloon sealer as defined in claim 9, wherein said pivot axles define an axis parallel to said channel.

11. A balloon sealer as in claim 10, wherein said anchor member is located outwardly of the axis passing through said pivot axles, relative to said channel.

* * * * *